United States Patent [19]

Franke

[11] 4,415,801

[45] Nov. 15, 1983

[54] PRINTER COUNTWHEEL MECHANISM

[75] Inventor: George Franke, Amherst, N.H.

[73] Assignee: Simplex Time Recorder Co., Gardner, Mass.

[21] Appl. No.: 252,499

[22] Filed: Apr. 8, 1981

[51] Int. Cl.[3] ..... G07G 1/00

[52] U.S. Cl. ..... 235/101; 235/132 E; 235/134; 235/143; 101/72; 101/79; 346/82

[58] Field of Search ..... 235/101, 134, 142, 143, 235/137, 132 E, 31 T, 58 R, 58 P, 58 CW; 101/72, 96, 79; 346/82

[56] References Cited

U.S. PATENT DOCUMENTS

| | | | |
|---|---|---|---|
| 671,128 | 4/1901 | Bundy | 346/82 |
| 979,585 | 12/1910 | Sokolov | 346/82 |
| 1,944,659 | 1/1934 | Ford . | |
| 3,139,027 | 6/1964 | Norman | 101/96 |
| 3,241,481 | 3/1966 | Gopperton | 101/96 |
| 4,055,116 | 10/1977 | Roberts et al. | 101/79 |

*Primary Examiner*—Benjamin R. Fuller
*Attorney, Agent, or Firm*—Seidel, Gonda & Goldhammer

[57] ABSTRACT

A printer countwheel mechanism in a time stamp machine keeps a running count of the number of groups of documents stamped by automatically advancing a countwheel to the next highest number when all documents in the group have been stamped. A document group comprises one or more documents. Each document in the group is stamped with the same countwheel number. When stamping single documents, i.e. groups consisting of only one document, the countwheel is advanced every stamping operation so that every document is stamped with a different number. When stamping duplicates, i.e. groups of two documents, the countwheel is advanced every other stamping operation so that duplicates are stamped with the same number. The mechanism may also be disengaged when it is not necessary to keep a count of the number of documents stamped.

11 Claims, 5 Drawing Figures

18
20
68
30
5
5
60
65
20
58
61
66
62
70
68
64
18
30
28
90
26
40
124
86
24
72
84
52
16
25
18
22
83
20
12
38
74
39
36
82
50
46

PRINTER COUNTWHEEL MECHANISM

BACKGROUND OF THE INVENTION

The present invention relates to time stamp machines, that is, machines which stamp documents with time information such as date of receipt or filing or the like.

When stamping ordinary documents, such as incoming mail, it is usually sufficient to stamp only the time and date of receipt. In certain cases, however, it is desirable to maintain a count of the number of documents stamped. For example, a bank may wish to stamp checks or other fiduciary documents and may wish to know how many documents have been stamped. In such case, it is necessary to stamp a sequence number on the document as well as the usual time and date information. Essentially, each printing or stamping operation is counted. In the event a document is to be stamped in duplicate, however, it is necesssary to count every two stamping operations, so that the original document and its duplicate are each stamped with the same sequence number.

SUMMARY OF THE INVENTION

The invention is directed to apparatus for counting stamping operations and printing corresponding sequential numbers on a document. The invention includes a countwheel provided with plural indicia representative of consecutive numbers and means for advancing the countwheel by at least one consecutive number past a preselected location at which which an indicium is impacted by a printing mechanism. The countwheel may be advanced after each operation of the printing mechanism or only after consecutive multiple operations of the mechanism.

It is an object of the invention to record like numerical data on each document in a group comprising one or more documents, and to provide for a no-count mode of operation when it is not desired to record such numerical data.

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

DETAILED DESCRIPTION OF THE INVENTION

Figure 1:
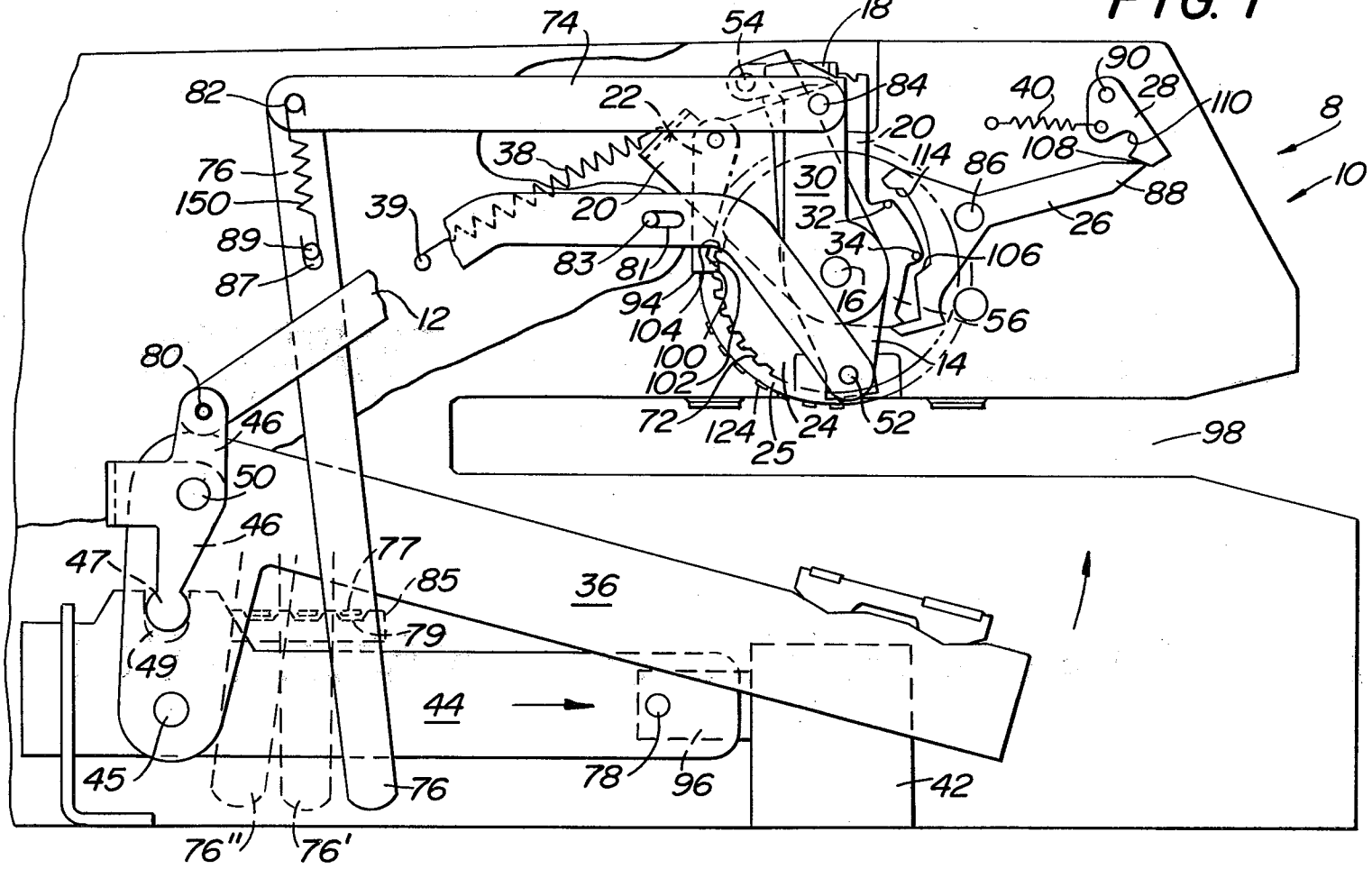
FIG. 1 is an elevation of the printer countwheel mechanism of the present invention.

Referring to the drawings, wherein like numerals indicate like elements, there is shown in FIG. 1 a printer countwheel mechanism 8 according to the present invention. The printer countwheel mechanism 8 is disposed within a time stamp housing 10. The mechanism includes a reciprocable link 12 which activates a countwheel advance mechanism in response to printing operations as described hereinafter. Link 12 is pivotably coupled to one end of a rotary lever 14 by a pin 52. The opposite end of lever 14 is pivotably coupled to a saddle advance pawl 18 by a pin 54. Lever 14 is freely mounted on a main shaft 16, on which are also freely mounted a countwheel 24, a saddle 20 and a rotary lever 30. The countwheel 24 has a smaller diameter portion provided with a plurality of teeth 72 around the peripheral surface and an integral larger diameter portion 25 coaxial therewith. Indicia 124 are located on the outer peripheral surface of portion 25 for printing indicia on documents. Although the invention is described herein in connection with a single countwheel, the invention contemplates the use of a bank of countwheels ganged in conventional manner so that any multiple digit number desired may be printed during a single operation. For ease of description and not by way of limitation, only a single countwheel is described herein. The lever 30 is pivotably coupled to a reciprocable link 74 by a pin 84. Link 74 is in turn pivotably coupled to a control lever 76 by pin 82.

The saddle 20 is yieldingly urged to a retracted position by a spring 38 coupled to the saddle and a frame post 39. See FIGS. 1 and 2. The saddle 20 has two pins 32 and 34 which in operation engage lock pawl 26 as described more fully hereafter. See FIG. 3. The lock pawl 26 pivots about a shaft 86. The end 88 of lock pawl 26 engages a cam 28, which is pivotably mounted on a pin 90 and biased toward the lock pawl 26 by a spring 40. A puch pawl 22 is pivotably mounted on a pin 92 secured to the saddle 20. The surface 94 of push pawl 22 engages the teeth 72 of the countwheel 24 as described more fully below.

COUNT BY ONE MODE

The invention as shown in FIG. 1 is set to operate in the count-by-one mode of operation. In the count-by-one mode of operation, a solenoid 42 is energized by conventional means (not shown) each time a document is inserted in the document slot 98. When the solenoid 42 is energized, plunger 96 is pulled into the solenoid, or to the right as viewed in FIG. 1. The plunger 96 is coupled to a link 44 by a pin 78. Thus, when solenoid 42 is energized, plunger 96 pulls link 44 toward the right. An arm 46 is rotatably mounted on a shaft 50. The arm 46 has an end portion 47 disposed in a recess 49 in the link 44. Movement of link 44 causes arm 46 to rotate on shaft 50 in the counterclockwise direction as viewed in FIG. 1. A print hammer 36 is pivotably coupled to link 44 by pin 45 and is mounted on shaft 50. The hammer rotates counterclockwise on shaft 50 in response to movement of the link 44 to the right. This is referred to as the forward stroke of the hammer. The pring hammer 36 presses the document inserted in slot 98 against the countwheel indicium 124 facing the document, whereby an indicium is printed on the document.

The crank arm 46 is pivotably coupled to link 12 by a pin 80. The link 12 is slidably mounted at slot 81 on a fixed pin 83. Link 12 is caused to move to the left as viewed in FIG. 1 in response to movement of plunger 96 to the right during each forward stroke of the print hammer. When plunger 96 is returned to its initial (rest) position, arm 46 is rotated clockwise by leftward motion of link 44. As a result, link 12 is moved to the right of pin 83, returning to its initial position.

Movement of link 12 to the left causes lever 14 to rotate in the clockwise direction as viewed in FIG. 1 about main shaft 16. The rotation of lever 14 causes pawl 18 to move to the right. As more clearly shown in FIG. 4, when pawl 18 moves to the right, pawl surface 62 contacts first saddle tooth 58, causing saddle 20 to rotate against the resistance of spring 38 in the clockwise direction through a prescribed angle equal to the circumferential spacing between consecutive countwheel teeth 72 or 12° by way of example.

Push pawl 22 is pivotably mounted on saddle 20 by pin 92 as previously indicated. Thus, the 12° clockwise rotation of saddle 20 causes the push pawl tip 100 to travel up inclined surface 102 of tooth 72 during the first 6° of travel of saddle 20 and then drop behind rear surface 104 of the countwheel tooth during the next 6° of travel of the saddle. See FIG. 3.

During the first 6° of travel of saddle 20, saddle tooth 56 clears lock pawl tooth 112. Cam 28 urges lock pawl 26 in the clockwise direction about shaft 86, and tooth surfaces 120 (saddle tooth) and 122 (lock pawl tooth) move into contact relation. During the next 6° of travel of saddle 20, pin 34 slidingly contacts lock pawl surface 106 causing lock pawl 26 to rotate about shaft 86 in the counterclockwise direction. At the same time, lock pawl tip 88 moves along cam surface 108 and drops into cam recess 110 which retains lock pawl 26 in the position indicated in FIG. 3 by phantom lines 26''. In this position, lock pawl tooth 112 is clear of saddle tooth 56 so that saddle 20 is free to rotate counterclockwise back to is initial position under force of spring 38.

After the forward stroke of print hammer 36, solenoid 42 is deenergized. When solenoid 42 is deenergized, plunger 96 moves to the left (as viewed in FIG. 1), pushing link 44 to the left whereby hammer 36 performs a return stroke and arm 46 rotates in the clockwise direction. The rotation of arm 46 in the clockwise direction causes link 12 to move to the right (as viewed in FIG. 1) thereby restoring link 12 to its initial position.

Figures 2, 4, 5:
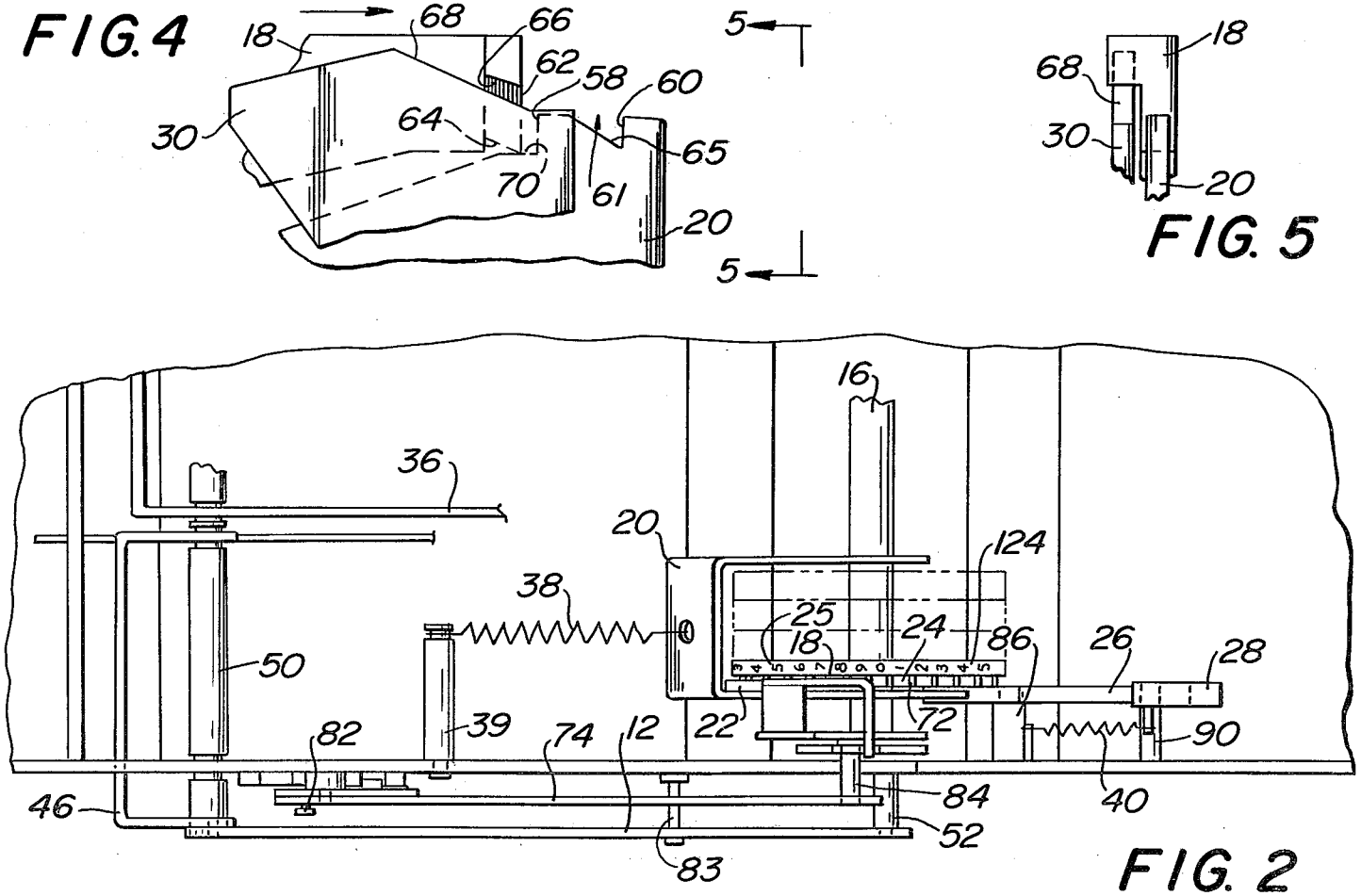
FIG. 2 is a plan view of the printer countwheel mechanism.
FIG. 4 is a detail of the pawl and saddle.
FIG. 5 is a detail of the pawl and saddle taken along the lines 5—5 in FIG. 4.
Figure 3:
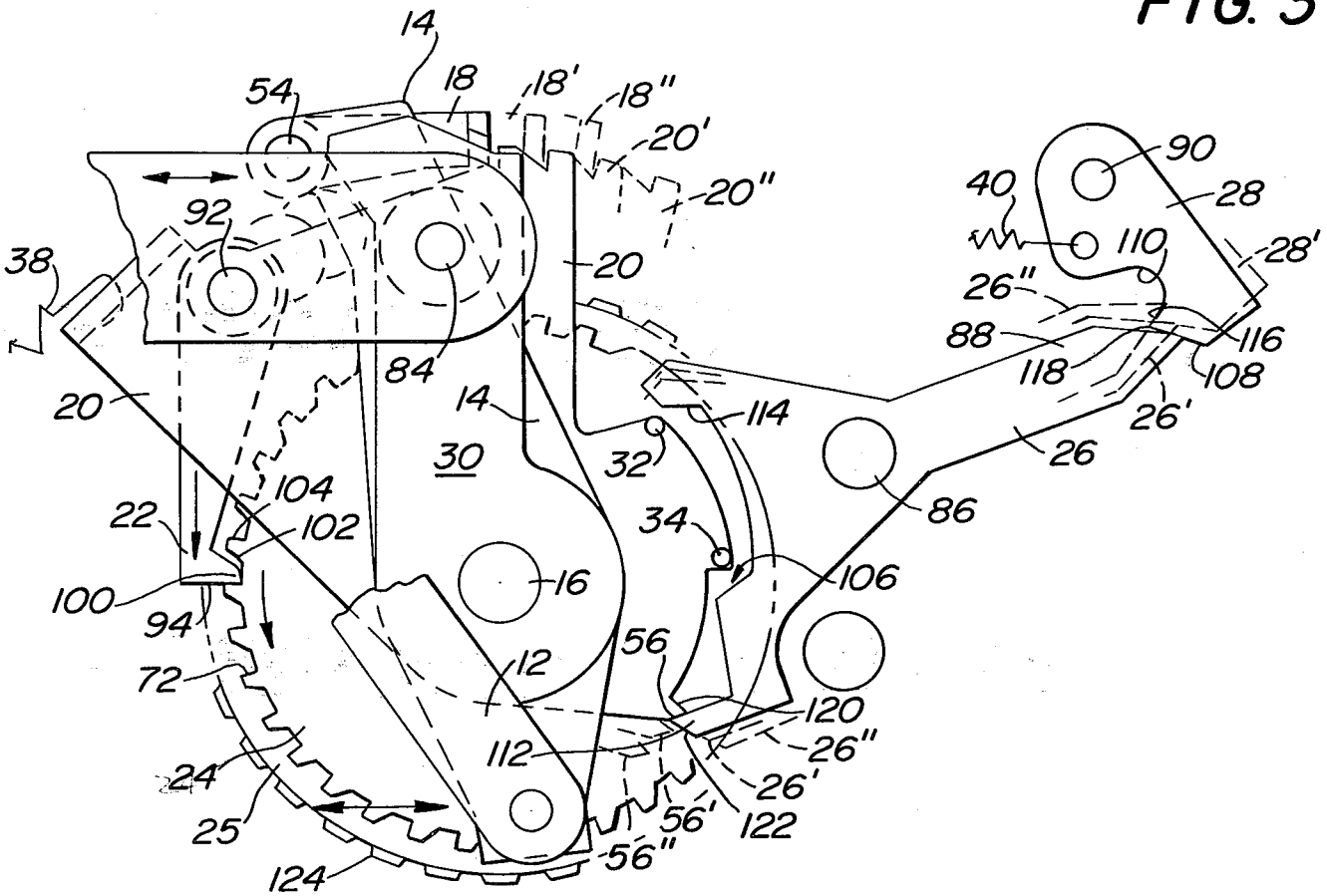
FIG. 3 is an enlarged elevation of the printer countwheel mechanism.

As shown more clearly in FIGS. 3 and 4, the rightward movement of link 12 causes lever 14 to rotate 12° in the counterclockwise direction about shaft 16, thereby retracting pawl 18 to the left and freeing saddle 20. Bias spring 38 then causes saddle 20 to rotate counterclockwise through 12°, returning the saddle to its rest position. The counterclockwise rotation of saddle 20 under the force of spring 38 causes push pawl surface 94 to push against rear surface 104 of countwheel tooth 72, thus advancing the countwheel in the counterclockwise direction by one tooth position or 12°. Accordingly, the indicium now facing the slot 98 bears the next digit in the numerical sequence.

During the first 6° counterclockwise rotation of saddle 20, saddle tooth 56 moves 6° counterclockwise while end 88 of lock pawl 26 remains captured in recess 110. Pin 34 releases from contact with lock pawl surface 106, lock pawl tooth 112 remains clear of the saddle tooth, and pin 32 moves into contact relation with lock pawl surface 114. During the second 6° rotation of saddle 20 pin 32 slidingly contacts lock pawl surface 114, causing lock pawl 26 to rotate about shaft 86 in the clockwise direction. Lock pawl tip 88 moves along cam surface 116, urging cam 28 in the counterclockwise direction about shaft 90, passes the cam tip 118, and slides along cam surface 108 coming to rest as shown in solid lines in FIG. 3. As lock pawl tip 88 moves along cam surface 116, cam 28 experiences a slight counterclockwise rotation about pin 90 against the resistance of spring 40. When lock pawl tip 88 clears cam tip 118, spring 40 causes cam 28 to rotate in the clockwise direction about pin 90 so that lock pawl tip 88 and cam surface 108 are in contact. Cam 28 returns to its rest position under force of spring 40, and lock pawl 26 slidingly contacts the top of tooth 55 as shown in solid lines in FIG. 3.

It will be apparent from the above sequence of operations that each printing operation causes the countwheel to be advanced by 12°, i.e. one tooth or one digit, so that every printing operation is being counted and indicated on consecutive documents.

COUNT BY TWO MODE

For count-by-two operation, control lever 76 is moved by the operator to the position indicated by 76' in FIG. 1. The control lever is provided with a finger 77 which lodges in any one of a series of detents 79 in frame member 85 to fix the angular position of the lever 76. The lever is pivotably mounted at slot 87 on a pin 89. Slot 87 is oversized to permit slight vertical movement of the lever 76 as finger 77 is moved from one detent to another upon movement of the lever by the operator. The control lever 76 is pivotably coupled to link 74 by a pin 82. A spring 150 is provided between pins 82 and 89 to maintain finger 77 in slidable contact with detents 79. Thus, the movement of control lever 76 from the position indicated in solid lines by 76 in FIG. 1 to the phantom position indicated by 76' causes link 74 to move to the right. Since link 74 and lever 30 are pivotably coupled at pin 84, lever 30 rotates clockwise about main shaft 16. The clockwise movement of lever 30 causes lever surface 68 (FIG. 4) to contact pawl bevel 66, pivoting pawl 18 counterclockwise about pin 54 so that bevel 66 slides up lever surface 68 to a position where surface 62 is lifted above first saddle tooth 58.

In the count-by-two mode of operation, when the solenoid is energized to print the first of a pair of duplicate documents, link 12 is caused to move to the left in accordance with the preceding description of operation of the mechanism. Leftward movement of link 12 causes lever 14 to rotate 12° in the clockwise direction about main shaft 16. The rotation of lever 14 causes pawl 18 to move to the right, as previously described. Because pawl 18 has been lifted initially by lever 30 to a position clear of first saddle tooth 58, the first 6 degrees of rotation of lever 14 are "lost" on saddle 20. That is, the first 6° rotation of lever 14 results in no displacement of saddle 20. Thus during the first 6° rotation of lever 14, pawl surface 62 passes over first saddle tooth 58. First saddle tooth 58 and second saddle tooth 60 are spaced 6° apart by detent 61 so that as surface 62 moves past tooth 58, pawl 18 pivots by gravity in the clockwise direction about pin 54 and pawl surface 64 enters detent 61. Pawl surface 62 is therefore positioned to contact second saddle tooth 60 after the first 6 degrees of rotation of lever 14. During the second 6 degrees of rotation of lever 14, pawl surface 62 pushes against second saddle tooth 60, thereby advancing the saddle 20 by 6 degrees in the clockwise direction. Thus, 12 degrees of rotation of lever 14 only causes 6 degrees of rotation of saddle 20 in the count-by-two mode.

During the first 6 degrees clockwise rotation of saddle 20, push pawl tip 100 travels up inclined surface 102 of countwheel tooth 72. However, because saddle 20 only rotates through 6 degrees during the first printing operation, push pawl tip 100 remains poised on tooth 72 and does not drop behind tooth 72.

When saddle 20 rotates through the first 6 degrees, saddle locking tooth 56 moves past lock pawl tooth 112. See FIG. 3. Lock pawl tooth 112 then drops behind saddle locking tooth 56 (solid lines) under force of spring 40 and cam 28 so that saddle locking tooth surface 120 is in contact with lock pawl tooth surface 122. This restrains saddle 20 from returning to its rest position under force of spring 38 after 12° rotation of lever 14, i.e. at the end of the first printing operation, as would occur in the count by one mode.

At the end of the first printing operation, lever 12 returns to the right, causing lever 14 to rotate 12° counterclockwise and withdraw pawl 18 from contact with saddle second tooth 60. More specifically, as lever 14 rotates counterclockwise, pawl surface 64 contacts and slides up inclined surface 65 of detent 61 while pawl 18 pivots counterclockwise to accommodate this motion. The pawl 18 and lever 14 return to theri initial positions, and pawl bevel 66 rides up saddle surface 68 so that pawl surface 62 lifts clear of saddle tooth 58.

When the second printing operation (for the duplicate copy) is initiated, link 12 again moves to the left causing lever 14 to rotate 12° clockwise. Because first saddle tooth 58 has been moved 6° clockwise during the first print operation, the first 6 degrees of rotation of lever 14 are "lost" on saddle 20. As in the first printing operation, the first 6° rotation of lever 14 merely results in pawl 18 moving into position to prepare to advance the saddle. In particular, during the first 6° rotation of lever 14 the pawl surface 62 now moves into contact relation with newly positioned first saddle tooth 58.

In the second 6° rotation of lever 14, pawl surface 62 pushes first saddle tooth 58, advancing the saddle 6° clockwise. The additional 6° rotation of saddle 20 causes push pawl tip 100 to slide over tooth 72 and then drop behind the tooth so that push pawl tip surface 94 contacts rear surface 104 of the countwheel tooth. See FIG. 3.

The second 6° rotation of saddle 20 simultaneously causes pin 34 to slidingly contact lock pawl surface 106, causing the lock pawl 26 to rotate about pin 86 in the counterclockwise direction so that lock pawl tooth 112 and saddle locking tooth 56 are disengaged. At the same time, lock pawl tip 88 moves along cam surface 108 and enters cam recess 110 whereby cam 28 retains lock pawl 26 in the position indicated in FIG. 3 by phantom lines 26''. Accordingly, saddle 20 is free to return under force of spring 38 to its initial position.

After the second printing operation is complete, saddle 20 is returned under force of spring 38 to its rest position, in the manner previously described, thereby causing push pawl 22 to advance the countwheel to the next indicium position.

It will be apparent from the above sequence of operations that the countwheel is advanced by one tooth or units digit every two printing operations in the count by two mode.

NO COUNT MODE

For no-count operation, control lever 76 is moved to the position indicated by phantom lines 76'' in FIG. 1. The movement of control lever 76 to the position indicated by 76'' in FIG. 1 causes link 74 to again move to the right. This in turn causes lever 30 to rotate clockwise about main shaft 16. Lever surface 68 (FIG. 4) slidingly contacts pawl bevel 66, thereby lifting pawl 18 so that pawl surface 62 is above first saddle tooth 58 and second saddle tooth 60. As compared to operation in the count-by-two mode, in the no-count mode the pawl 18 is elevated such that subsequent clockwise motion of lever 14 will not result in pawl surface 64 entering detent 61. Thus, in the no-count mode, when lever 14 is caused to rotate 12° clockwise during a printing operation, pawl 18 does not contact either first saddle tooth 58 or second saddle tooth 60. The entire 12° rotation of lever 14 is "lost" on the saddle 20. Accordingly, in the no-count mode saddle 20 is not rotated at all during a printing operation, and the countwheel remains at its previous setting or number.

The present invention may be embodied in other specific forms with departing from the spirit or essential attributes thereof and, accordingly, reference should be made to the appended claims, rather than to the foregoing specification, as indicating the scope of the invention.

I claim:

1. Apparatus for maintaining a count of print operations performed by a printing mechanism and for printing the count, comprisng:

(a) counting means having indicia representative of consecutive numbers, said counting means being displaceable with respec to a preselected position at which at least one of said indicia is impacted by the printing mechanism;

(b) means for displacing said counting means after a selectable number of said print operations such that consecutive indicia move into alignment with said preselected position after said selectable number of print operations is completed;

(c) means operatively associated with said means for displacing said counting means for preselecting said number of print operations;

(d) means for causing the printing mechanism to impact the indicia aligned at the preselected position during each print operation.

2. Apparatus according to claim 1 wherein said counting means comprises a rotary countwheel having a first diameter portion and a second enlarged diameter portion integral and coaxial with said first diameter portion, said first diameter portion having a plurality of teeth along the outer peripheral surface thereof and said second diameter portion having a plurality of indicia representative of consecutive numbers along the outer peripheral surface thereof, and wherein said means for displacing said counting means comprises means for advancing said countwheel by at least one indicia position after each number of print operations is completed.

3. Apparatus according to claim 1 including means for disabling said means for displacing said counting means to prevent displacement of said counting means after completion of a number of print operations.

4. Apparatus for maintaining a count of print operations performed by a printing mechanism and for printing the count, comprising:

(a) a countwheel having plural indicia representative of consecutive numbers, said countwheel being displaceable past a preselected position at which a countwheel indicia is impacted by the printing mechanism;

(b) means for advancing said countwheel after a selectable number of print operations such that consecutive countwheel indicia move into alignment with said preselected position after said selectable number of print operations is completed;

(c) means operatively associated with said means for advancing said countwheel for preselecting said number of print operations;

(d) means for causing the printing mechanism to impact the countwheel indicum aligned at said preselected position during each print operation.

5. Apparatus according to claim 4 wherein said means for advancing said countwheel includes means coupled to the printing mechanism for preventing displacement of the countwheel during each number of print operations and for displacing the countwheel only after each number of print operations has been completed and before the next number of print operations has begun.

6. Apparatus for maintaining a count of print operations performed by a printing mechanism and for printing the count, comprising:

(a) a rotary countwheel having plural teeth indicia representative of consecutive numbers;

(b) a rotary lever coupled to the printing mechanism for reciprocable displacement over a preselected angle during a print operation;

(c) means for displacing the countwheel in response to reciprocable displacement of the rotary lever over said preselected angle;

(d) means for preventing displacement of the countwheel during a number of print operations, each group comprising two or more consecutive print operations, and for enabling said countwheel to be displaced only after each number of print operations is completed and before the next number of print operations is begun.

7. Apparatus for maintaining a count of print operations performed by a printing mechanism and for printing the count, comprising:

(a) a rotary countwheel having a first diameter portion and a second enlarged diameter portion integral and coaxial with said first diameter portion, said first diameter portion having a plurality of teeth along the outer peripheral surface thereof and said second diameter portion having a plurality of indicia representative of consecutive numbers along the outer peripheral surface thereof, said rotary countwheel being displaceable with respect to a preselected position at which one of said indicia can be impacted by the printing mechanism;

(b) a rotary lever coupled to the printing mechanism for reciprocable movement over a preselected angle during a print operation;

(c) a saddle advance pawl pivotably mounted on said lever for reciprocable movement therewith;

(d) a rotary saddle adapted and arranged to be contacted and advanced by said saddle advance pawl as said lever moves over said preselected angle in a first direction;

(e) resilient means for returning said saddle to an initial position after advancement of the saddle by said saddle advance pawl;

(f) a countwheel advance pawl pivotably mounted on said saddle for sliding contact with said countwheel teeth as said saddle is advanced in said first direction by said saddle advance pawl and for advancing said countwheel by at least one indicium position as said saddle is returned to its initial position by said resilient means;

(g) means for preventing said countwheel advance pawl from advancing said countwheel during a number of one or more consecutive print operations and for enabling said countwheel advance pawl to advance said countwheel only after said number of print operations has been completed and before the next number of print operations has begun;

(h) means for causing the printing mechanism to impact the countwheel indicium aligned at the preselected position during each print operation.

8. Apparatus according to claim 7 including means for adjustably pre-positioning said saddle advance pawl to prevent said saddle advance pawl from displacing said saddle during an adjustable portion of the movement of said lever in said first direction.

9. Apparatus according to claim 8 including means for pre-positioning said saddle advance pawl to prevent displacement of said saddle from its initial position by said saddle advance pawl throughout a group of print operations.

10. Apparatus for maintaining a count of print operations performed by a printing mechanism and for printing the count, comprising:

(a) a rotary countwheel having a first diameter portion and a second enlarged diameter portion integral and coaxial with said first diameter portion, said first diameter portion having a plurality of teeth along the outer peripheral surface thereof and said second diameter portion having a plurality of indicia representative of consecutive numbers along the outer peripheral surface thereof, wheel being displaceable such that each of said indicia are alignable with a preselected position at which an indicium is impacted by the printing mechanism;

(b) a rotary saddle;

(c) means for resiliently biasing said saddle in an initial position and for returning said saddle to the initial position after displacement of the saddle therefrom;

(d) means coupled to the printing mechanism for displacing said saddle by a preselected angle with respect to said initial position during a print operation;

(e) adjustable means operatively associated with said means for displacing said saddle for causing said means for displacing said saddle to displace said saddle over said preselected angle only after completion of a number of print operations comprising one or more consecutive print operations;

(f) means for preventing said saddle from returning to its initial position until said saddle is displaced by said preselected angle from the initial position and for enabling said saddle to return to the initial position thereafter;

(g) means for advancing the countwheel by at least one indicium position as said saddle returns to its initial position.

11. Apparatus according to claim 10 wherein said means for preventing said saddle from returning to its initial position comprises a rotary lock pawl provided with a lock pawl tooth and wherein said saddle is provided with a saddle locking tooth engageable by said lock pawl tooth to arrest said saddle during a print operation.

* * * * *